US011183782B2

(12) United States Patent
Beck et al.

(10) Patent No.: US 11,183,782 B2
(45) Date of Patent: Nov. 23, 2021

(54) ADJUSTABLE NEUTRAL BARS AND ADJUSTABLE NEUTRAL BAR ASSEMBLIES

(71) Applicant: HUBBELL INCORPORATED, Shelton, CT (US)

(72) Inventors: Alan Douglas Beck, Liberty Township, OH (US); Jonathan Isaiah Speicher, Cincinnati, OH (US); Michael Duane Amburgey, Liberty Township, OH (US)

(73) Assignee: Hubbell Incorporated, Shelton, CT (US)

( * ) Notice: Subject to any disclaimer, the term of this patent is extended or adjusted under 35 U.S.C. 154(b) by 27 days.

(21) Appl. No.: 16/352,039

(22) Filed: Mar. 13, 2019

(65) Prior Publication Data

US 2020/0295478 A1 Sep. 17, 2020

(51) Int. Cl.

| | |
|---|---|
| ***H01R 9/24*** | (2006.01) |
| ***H01R 4/36*** | (2006.01) |
| ***H01R 25/14*** | (2006.01) |
| ***H01R 25/16*** | (2006.01) |

(52) U.S. Cl.

CPC ..... *H01R 9/2483* (2013.01); *H01R 4/36* (2013.01); *H01R 9/2458* (2013.01); *H01R 25/14* (2013.01); *H01R 25/145* (2013.01); *H01R 25/162* (2013.01)

(58) Field of Classification Search

CPC .. H01R 9/2483; H01R 25/162; H01R 25/145; H01R 25/14; H01R 9/2458; H01R 4/36

See application file for complete search history.

(56) References Cited

U.S. PATENT DOCUMENTS

| | | | | |
|---|---|---|---|---|
| 1,943,660 | A * | 1/1934 | Edwards | H01R 4/36 439/798 |
| 2,909,757 | A | 8/1952 | Speck | |
| 2,967,287 | A | 1/1961 | Sori | |
| 3,383,458 | A * | 5/1968 | Raskhodoff | H02G 5/005 174/72 B |
| 3,594,710 | A | 7/1971 | Stanback | |
| 4,231,633 | A | 11/1980 | Luke | |
| 5,777,263 | A | 7/1998 | Maehler | |
| 6,252,166 | B1 | 6/2001 | Leschinger | |
| 6,459,570 | B1 | 10/2002 | Buchanan | |
| 6,664,469 | B1 | 12/2003 | Sweeney | |
| 7,056,163 | B2 * | 6/2006 | Hay | H01R 4/36 439/810 |
| D524,248 | S | 7/2006 | Sweeney | |

(Continued)

OTHER PUBLICATIONS

International Search Report dated May 7, 2020 in corresponding International Application PCT/US2020/018044.

(Continued)

*Primary Examiner* — Renee S Luebke
*Assistant Examiner* — Paul D Baillargeon
(74) *Attorney, Agent, or Firm* — Ohlandt, Greeley, Ruggiero & Perle, L.L.P.

(57) ABSTRACT

An adjustable neutral bar and adjustable neutral bar assemblies are provided. The bars and bar assemblies are adjustable to a desired number of taps. The bars and bar assemblies can have mating bar ends or clips that allow for easy connection of multiple bars to one another. Additionally, the bars and bar assemblies can have shear regions that allow for easy separation of a bar at a desired location.

18 Claims, 9 Drawing Sheets

(56) References Cited

U.S. PATENT DOCUMENTS

| | | | | |
|---|---|---|---|---|
| D531,131 | S | 10/2006 | Sweeney | |
| 8,277,263 | B1 * | 10/2012 | Smith | H01R 4/32 439/779 |
| 8,425,264 | B2 * | 4/2013 | Michell | H01R 4/42 439/789 |
| 8,480,414 | B2 * | 7/2013 | Carnevale | H01R 9/2483 439/97 |
| 8,747,170 | B2 * | 6/2014 | Cornelius | H01R 11/11 439/798 |
| 10,135,158 | B2 * | 11/2018 | Peltier | H01R 4/36 |

OTHER PUBLICATIONS

Written Opinion dated May 7, 2020 in corresponding International Application PCT/US2020/018044.

* cited by examiner

ADJUSTABLE NEUTRAL BARS AND ADJUSTABLE NEUTRAL BAR ASSEMBLIES

BACKGROUND

1. Field of the Invention

The present disclosure is related to neutral bars and neutral bar assemblies. More particularly, the present disclosure is related to neutral bars and neutral bar assemblies that are adjustable to a desired number of taps.

2. Description of Related Art

Neutral is a circuit conductor that normally carries current back to the source. Neutral is usually connected to ground (earth) at the main electrical panel, breaker box, street drop, or meter, and also at the final step-down transformer of the supply.

Neutral bars are known devices commonly used in main electric panels, breaker boxes, or other electrical enclosures. The neutral bar is used to connect a number of different neutral conductors to different slots or taps ("taps") on the neutral bar. The neutral bar is made of an electrically conductive material such as, but not limited to, copper, aluminum, other metals, and alloys of these or other metals.

Typically, each tap on the neutral bar consists of two openings—a first opening and a second opening. The first opening is sized to receive one of the neutral conductors, while the second opening has compression member positioned therein (e.g., a wire-binding screw). The first and second openings are positioned with respect to one another to allow the compression member to be selectively tightened to mechanically secure the neutral conductor in the tap in an electrically conductive manner.

Neutral bars, like many electrical devices, are subject to one or more different safety certifications. For example, the Underwriters Laboratories ("UL") provides product safety testing and certification for electrical devices. Obtaining UL certification and maintaining that certification in the as installed state can be valuable in the marketing of such products.

Many designs have been proposed to allow the end user to design an electrical enclosure with a neutral bar having a desired number of taps—while still maintaining the original safety certification. Many such products require the use of multiple neutral bars that are electrically and structurally secured together with a complex number of connectors and expanders. This allows the end user to configure the electrical enclosure with as many taps as desired.

However, the present application has determined that prior art designs often require a burdensome number of components, the supply of which can be difficult to manage and the assembly of which can be problematic. The present disclosure has also determined that other prior art designs often result in modification of the neutral bar in a manner that can void prior safety certifications.

Accordingly, it has been determined by the present disclosure that there is a need for adjustable neutral bars and adjustable neutral bar assemblies that overcome, alleviate, and/or mitigate one or more of the aforementioned and other deleterious effects of the prior art.

SUMMARY

An adjustable neutral bar is provided. The bar includes wire-binding screws, first openings, second openings, a first bar end, and a second bar end. The first openings are sized to receive a different neutral conductor. The second openings have a thread that receives the wire-binding screws. The first and second openings are positioned with respect to one another to allow the wire-binding screws to be selectively tightened in the second openings to mechanically secure the different neutral conductors in the first openings in an electrically conductive manner. The first bar end has a first hole, while the second bar end has a second hole. The first and second bar ends are positioned and shaped so that the first end of one neutral bar is mateable with the second end of a different neutral bar and, when mated, the first and second holes aligning with one another.

In some embodiments either alone or together with any one or more of the aforementioned and/or after-mentioned embodiments, the first and second ends have a step shape.

In some embodiments either alone or together with any one or more of the aforementioned and/or after-mentioned embodiments, the first end has a female shape and the second end has a male shape that corresponds to the female shape.

In some embodiments either alone or together with any one or more of the aforementioned and/or after-mentioned embodiments, the first and second ends form an interference fit when engaged.

In some embodiments either alone or together with any one or more of the aforementioned and/or after-mentioned embodiments, the first end has an inner dimension that is smaller in at least one direction than an outer dimension of the second end.

In some embodiments either alone or together with any one or more of the aforementioned and/or after-mentioned embodiments, the first end has an inner radius (IR) that is smaller than an outer radius (OR) of the second end.

In some embodiments either alone or together with any one or more of the aforementioned and/or after-mentioned embodiments, the male and female shapes are quadrangle shapes.

An adjustable neutral bar is also provided that has wire-binding screws, first openings, second openings, and a shearing region. The first openings are sized to receive a different neutral conductor. The second openings have a thread that receives the wire-binding screws. The first and second openings are positioned with respect to one another to allow the wire-binding screws to be selectively tightened in the second openings to mechanically secure the neutral conductors in the first openings in an electrically conductive manner. The shearing region is between two of the first openings and/or two of the second openings that are adjacent to one another, respectively.

In some embodiments either alone or together with any one or more of the aforementioned and/or after-mentioned embodiments, the shearing region has a predefined spacing between the two of the first openings and/or the two of the second openings.

In some embodiments either alone or together with any one or more of the aforementioned and/or after-mentioned embodiments, the shearing region defines a shearing plane for the shearing of the neutral bar.

In some embodiments either alone or together with any one or more of the aforementioned and/or after-mentioned embodiments, the shearing region is a physical locator that can interact with a die set to ensure proper location of the die set with respect to the shearing region.

An adjustable neutral bar assembly is also provided that includes two neutral bars and a connector. Each bar has wire-binding screws, first openings, second openings, a first bar end, and a second bar end. The first openings receive a different neutral conductor. The second openings have a thread that receives the wire-binding screws. The first and second openings are positioned with respect to one another to allow the wire-binding screws to be selectively tightened in the second openings to mechanically secure the neutral conductors in the first openings in an electrically conductive manner. The first bar end has a first hole, while the second bar end has a second hole. The connector mechanically and electrically secures the first bar end of one of the two neutral bars and the second bar end of the other of the two neutral bars through the first hole of the first end and the second hole of the second end, which are aligned with one another.

In some embodiments either alone or together with any one or more of the aforementioned and/or after-mentioned embodiments, the first and second ends have a step shape.

In some embodiments either alone or together with any one or more of the aforementioned and/or after-mentioned embodiments, the first end has a female shape and the second end has a male shape that corresponds to the female shape.

In some embodiments either alone or together with any one or more of the aforementioned and/or after-mentioned embodiments, the first and second ends form an interference fit when engaged.

In some embodiments either alone or together with any one or more of the aforementioned and/or after-mentioned embodiments, the male and female shapes are quadrangle shapes.

An adjustable neutral bar assembly is also provided that includes two neutral bars and a clip. Each neutral bar includes wire-binding screws, first openings, second openings, a first bar end, and a second bar. The first openings receive a different neutral conductor. The second openings have a thread that receives the wire-binding screws. The first and second openings are positioned with respect to one another to allow the wire-binding screws to be selectively tightened in the second openings to mechanically secure the neutral conductors in the first openings in an electrically conductive manner. The clip mechanically and electrically secures the two neutral bars to one another so that the first bar end of one of the two neutral bars and the second bar end of the other of the two neutral bars face and/or abut one another.

In some embodiments either alone or together with any one or more of the aforementioned and/or after-mentioned embodiments, the clip includes an upper section with a first hole and a second hole. The first and second holes are positioned on the upper section so that the first hole aligns with the second opening of one of the two neutral bars and the second hole aligns with the second opening of the other of the two neutral bars.

In some embodiments either alone or together with any one or more of the aforementioned and/or after-mentioned embodiments, one wire-binding screw mechanically and electrically secures the clip via the first hole to one of the two neutral bars, and another wire-binding screw mechanically and electrically secures the clip via the second hole to the other of the two neutral bars.

In some embodiments either alone or together with any one or more of the aforementioned and/or after-mentioned embodiments, the clip further includes a lower section having a first extension and a second extension. The first and second extensions are positioned on the lower section so that the first extension aligns with the first opening of one of the two neutral bars and the second extension aligns with the first opening of the other of the two neutral bars.

The above-described and other features and advantages of the present disclosure will be appreciated and understood by those skilled in the art from the following detailed description, drawings, and appended claims.

DETAILED DESCRIPTION

Figure 1:
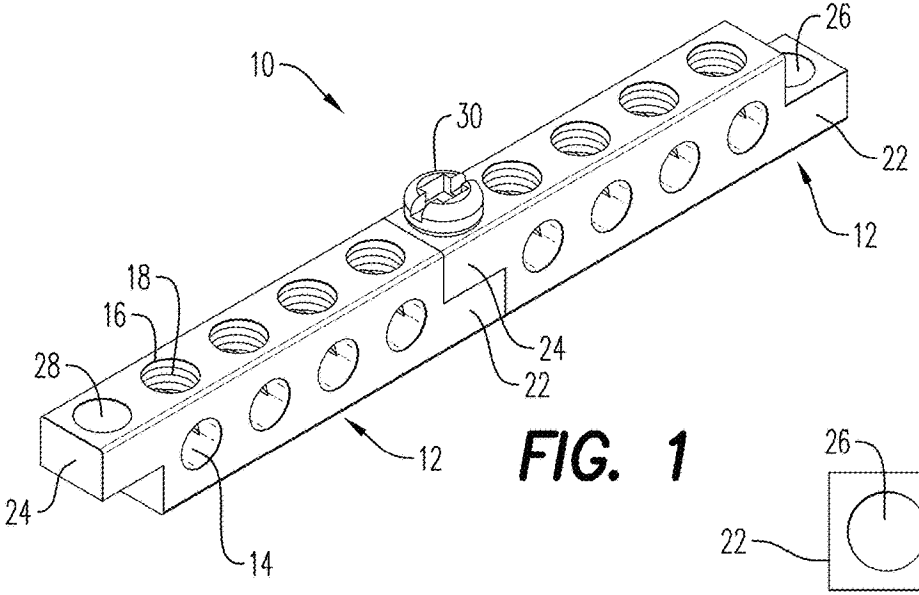
FIG. 1 is a perspective view of an adjustable neutral bar assembly according to the present disclosure.
Figure 2:
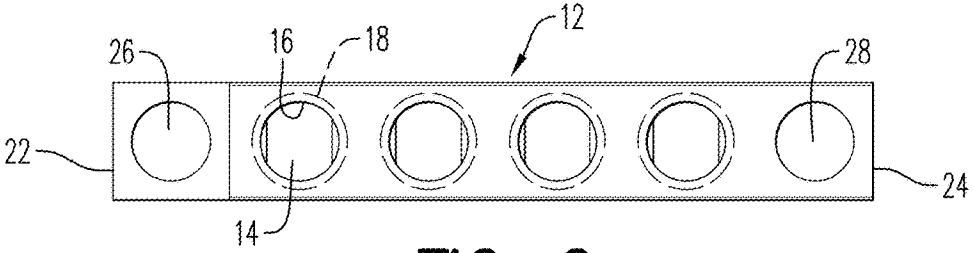
FIG. 2 is a top view of one of the neutral bars in the assembly of FIG. 1.
Figure 3:
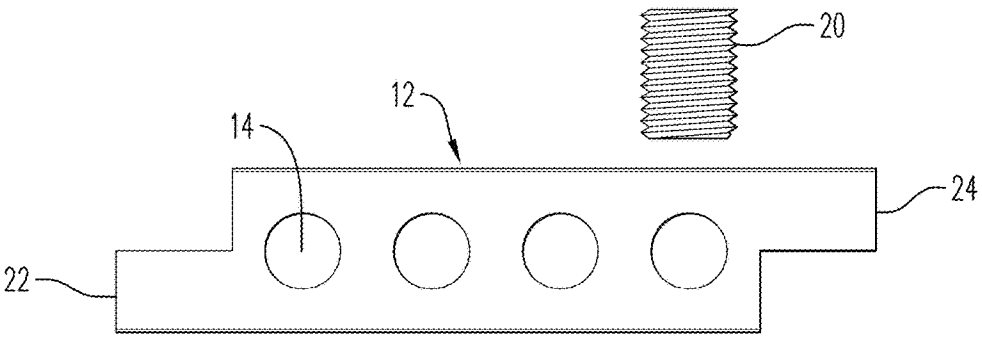
FIG. 3 is a side view of the neutral bar of FIG. 2.

Referring to the drawings and in particular to FIGS. 1-3, an exemplary embodiment of an adjustable neutral bar assembly according to the present disclosure is shown and is generally referred to by reference numeral 10. Advantageously, assembly 10 is configurable to provide any desired number of taps by joining a plurality of neutral bars 12 to one another.

Assembly 10 is illustrated by way of example as having two bars 12 secured to one another by way of example only. However, it is contemplated by the present disclosure for assembly 10 to include any desired number of bars 12 secured to one another.

Each bar 12 includes a first opening 14 and a second opening 16. Each first opening 14 (four shown) is sized to receive a neutral conductor (not shown). Each second opening 16 has an internal thread 18, configured to threadably receive a wire-binding screw 20 (one shown) therein. First and second openings 14, 16 are positioned with respect to one another to allow screw 20 to be selectively tightened in the second opening to mechanically secure the neutral conductor in the first opening in an electrically conductive manner.

Bars 12 are shown by way of example as having four sets of openings 16/18. Of course, it is contemplated by the present disclosure for bars 12 to have any desired number of sets of openings 16/18 such as, but not limited to, at least one set of openings and as many as thirty sets of openings.

Each bar 12 also includes a first bar end 22 and a second bar end 24. First end 22 has a first hole 26, while second end 24 has a second hole 28. Ends 22, 24 are positioned and shaped so that the first end 22 of one bar 12 mates with second end 24 of a different bar 12. When mated, first and second holes 26, 28 align with one another for receipt of a connector 30, which mechanically and electrically secures the bars to one another to form assembly 10.

In the illustrated embodiment, connector 30 is shown as a screw that threadably engages corresponding threads in one or both holes 26, 28. In this manner, assembly 10 can easily and repeatably be formed by the user by providing as many bars 12 as necessary for a particular use. As such, bars 12—as a result of ends 22, 24—are considered by the present disclosure to be adjustable neutral bars.

It should be recognized that bars 12 are illustrated by way of example having ends 22, 24 positioned so that holes 26, 28 and connector 30 are parallel to second opening 16 and screw 20. However, it is also contemplated by the present disclosure for bars 12 to be configured so that ends 22, 24 are positioned with holes 26, 28 and connector 30 parallel to first openings 14 and the neutral conductors (not shown). In some embodiments, connector 30 is the same type and size as screw 20.

Moreover, assembly 10 is illustrated by way of example as having bars 12 with ends 22, 24 configured so that the bars are secured to one another in a straight line. However, it is contemplated by the present disclosure for assembly 10 to include bars 12 having ends 22, 24 configured so that the bars are secured to one another angled with respect to one another. Moreover, assembly 10 can include bars 12 having ends 22, 24 configured so that the user can select the angle of the bars with respect to one another.

Advantageously, assembly 10 combines two identically shaped bars 12, minimizing the number of components necessary to adjust (i.e., expand or contract) the number of taps available. Moreover, when connector 30 is identical to screw 20, assembly 10 requires no more parts than would be required when installing only one bar 12. Since there is no modification necessary to the structure of bars 12, assembly 10 can maintain any safety certification in the as installed state.

It should be recognized that although bars 12 are described as being identically shaped, it is contemplated by the present disclosure for this to mean that the ends 22, 24 are shaped in a corresponding manner so as to allow for connection of the bars as described. In this way, bars 12 having a different number of taps can be connected together to adjust the number of taps as desired.

In the embodiment of FIGS. 1-3, ends 22, 24 have a step shape that allows the first end of one bar 12 to mate with the second end of a different bar. However, it should be recognized that the present disclosure contemplates bars 12 having ends 22, 24 of any position and/or shape that allows mating of the first end of one bar with the second end of a different bar.

Figure 4:
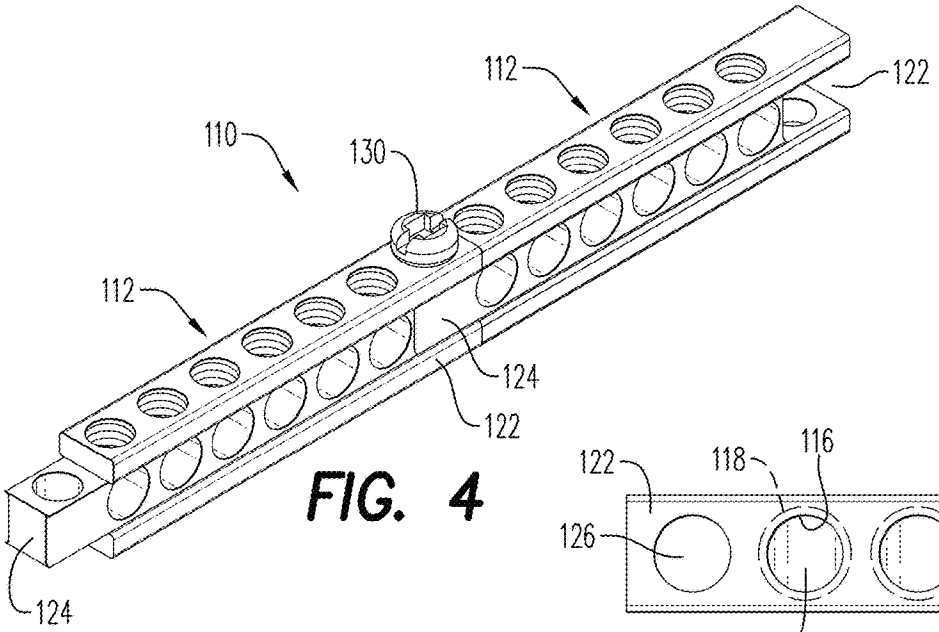
FIG. 4 is a perspective view of another adjustable neutral bar assembly according to the present disclosure.
Figure 5:
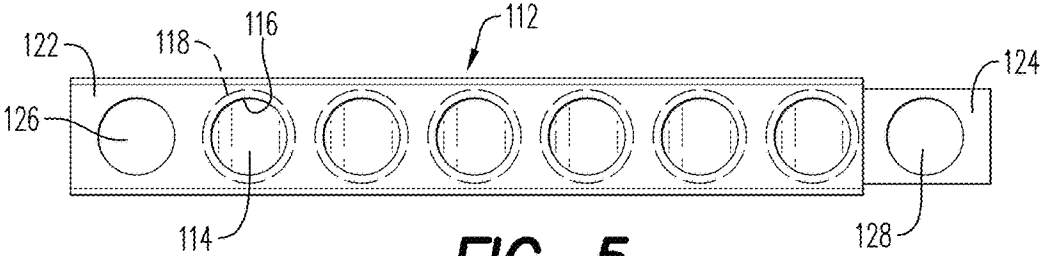
FIG. 5 is a top view of one of the neutral bars in the assembly of FIG. 4.
Figure 6:
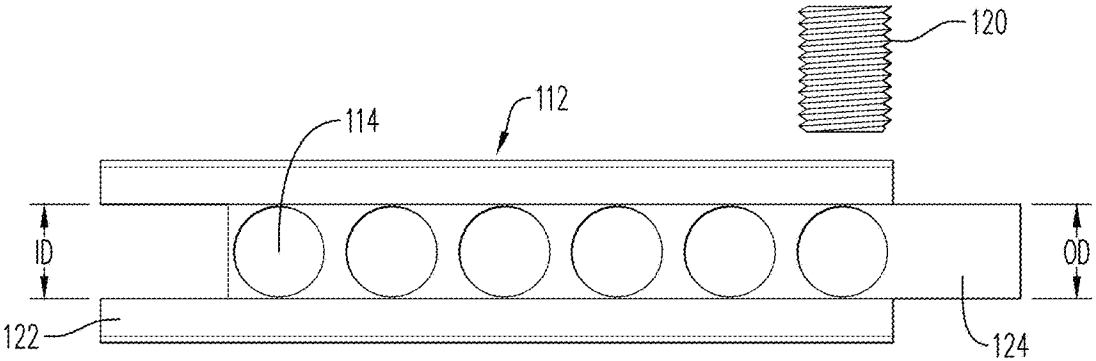
FIG. 6 is a side view of the neutral bar of FIG. 5.
Figure 7:
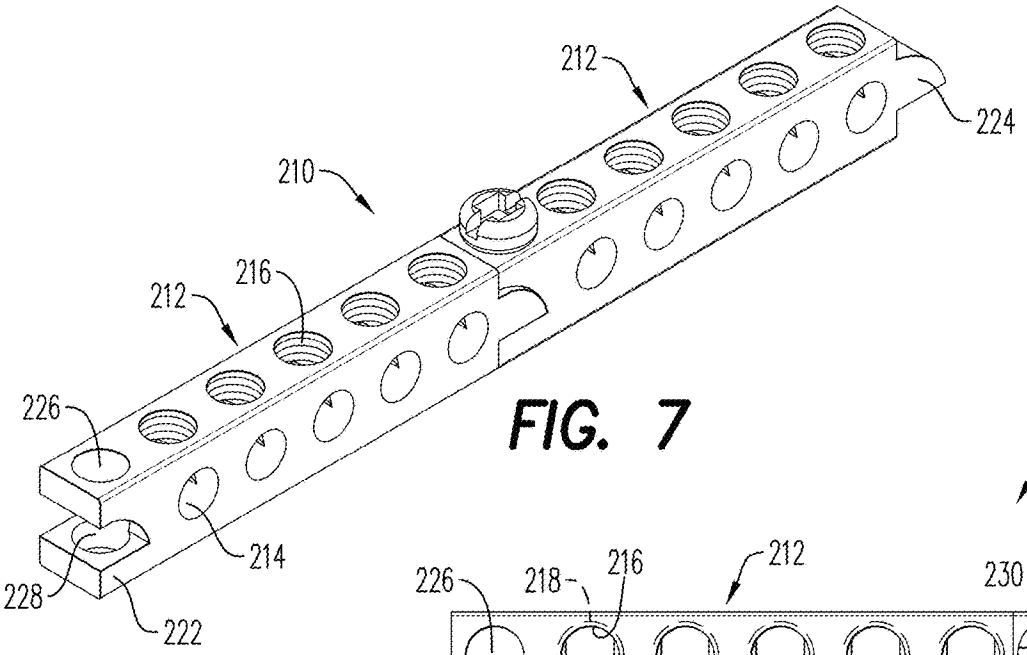
FIG. 7 is a perspective view of another adjustable neutral bar assembly according to the present disclosure.
Figure 8:
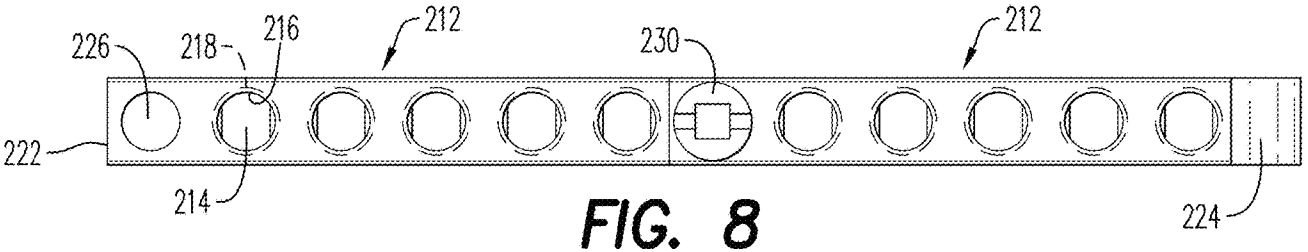
FIG. 8 is a top view of the adjustable neutral bar assembly of FIG. 7.
Figure 9:
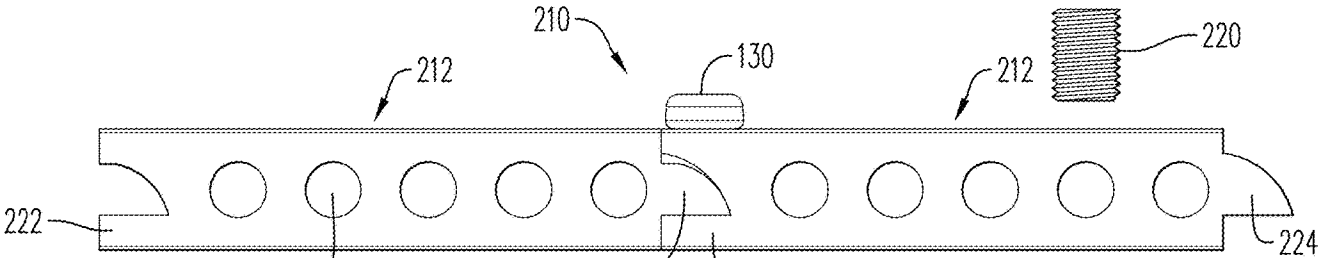
FIG. 9 is a side view of the adjustable neutral bar assembly of FIG. 7.

For example, another embodiment of an adjustable neutral bar assembly according to the present disclosure is shown in FIGS. 4-6. Here, component parts performing similar and/or analogous functions as those discussed above with respect to FIGS. 1-3 are referred to in multiples of one hundred.

Again, assembly 110 is configurable to provide any desired number of taps by joining a plurality of neutral bars 112 to one another. Bars 112 include first opening 114 and second opening 116 having internal thread 118, configured to threadably receive a wire-binding screw 120. First and second openings 114, 116 are positioned with respect to one another to allow screw 120 to be selectively tightened in the second opening to mechanically secure the neutral conductor in the first opening in an electrically conductive manner.

Each bar 112 includes first and second bar end 122, 124 having, respectively, first and second holes 126, 128. Ends 122, 124 are positioned and shaped so that the first end 122 of one bar 112 mates with second end 124 of a different bar 112. When mated, first and second holes 126, 128 align with one another for receipt of a connector 130, which mechanically and electrically secures the bars to one another to form assembly 110. In this embodiment, end 122 has a female shape, while end 124 has a male shape that allows the first end of one bar 112 to mate within the second end of a different bar.

In some embodiments, it is contemplated by the present disclosure for first end 122 to have an inner dimension (ID) that is smaller in at least one direction than an outer dimension (OD) of second end 124. In this way, ends 122, 124 can form an interference fit when engaged, with connector 130 adding compression to the engagement to form a secure mechanical and electrical connection.

It should be recognized that bars 112 are illustrated by way of example having ends 122, 124 positioned so that holes 126, 128 and connector 130 are parallel to second opening 116 and screw 120. However, it is also contemplated by the present disclosure for bars 112 to be configured so that ends 122, 124 are positioned with holes 126, 128 and connector 130 parallel to first openings 114 and the neutral conductors (not shown).

Moreover, assembly 110 is illustrated by way of example as having bars 112 with ends 122, 124 configured so that the bars are secured to one another in a straight line. However, it is contemplated by the present disclosure for assembly 110 to include bars 112 having ends 122, 124 configured so that the bars are secured to one another angled with respect to one another. Moreover, assembly 110 can include bars 112 having ends 122, 124 configured so that the user can select the angle of the bars with respect to one another.

Advantageously, assembly 110 combines two identically shaped bars 112, minimizing the number of components necessary to adjust (i.e., expand or contract) the number of taps available. Moreover, when connector 130 is identical to screw 120, assembly 110 requires no more parts than would be required when installing only one bar 112. Since there is no modification necessary to the structure of bars 112, assembly 110 can maintain any safety certification in the as installed state.

Again, it should be recognized that although bars 112 are described as being identically shaped, it is contemplated by the present disclosure for this to mean that the ends 122, 124 are shaped in a corresponding manner so as to allow for connection of the bars as described. In this way, bars 112 having a different number of taps can be connected together to adjust the number of taps as desired.

Accordingly, bars 112—as a result of ends 122, 124—are considered by the present disclosure to be adjustable neutral bars.

In the embodiment of FIGS. 4-6, ends 122, 124 have a male-female shape with a generally quadrangle shape that allows the first end of one bar 112 to mate in the second end of a different bar. However, it should be recognized that the present disclosure contemplates bars 12 having ends 122, 124 of any position and/or shape that allows mating of the first end of one bar with the second end of a different bar.

For example, yet another embodiment of an adjustable neutral bar assembly according to the present disclosure is shown in FIGS. 7-11. Here, component parts performing similar and/or analogous functions as those discussed above with respect to FIGS. 1-3 and FIGS. 4-6 are referred to in multiples of two hundred.

Again, assembly 210 is configurable to provide any desired number of taps by joining a plurality of neutral bars 212 to one another. Bars 212 include first opening 214 and second opening 216 having internal thread 218, configured to threadably receive a wire-binding screw 220. First and second openings 214, 216 are positioned with respect to one another to allow screw 220 to be selectively tightened in the second opening to mechanically secure the neutral conductor in the first opening in an electrically conductive manner.

Each bar 212 includes first and second bar end 222, 224 positioned and shaped so that the first end 222 of one bar 212 mates with second end 224 of a different bar 212. In this embodiment, first end 222 has at least a first hole 226—and in some embodiments a second hole 228. When mated, a connector 230 can be threadably received in first hole 226 and/or second hole 228 to mechanically and electrically secure the bars to one another to form assembly 210. In this embodiment, end 222 has a female shape, while end 224 has a male shape that allows the first end of one bar 212 to mate within the second end of a different bar.

Figure 11:
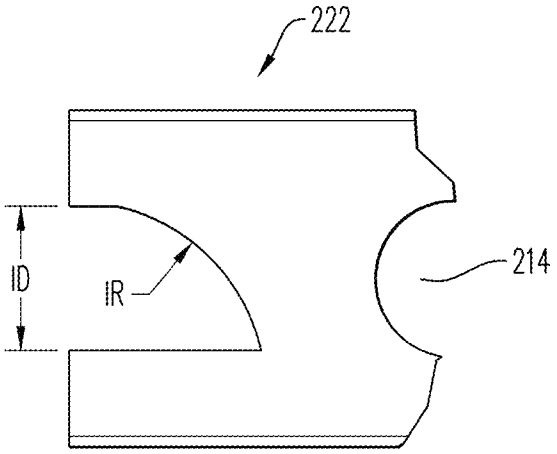
FIG. 11 is an enlarged side view of a second side of the adjustable neutral bar assembly of FIG. 7.
Figure 10:
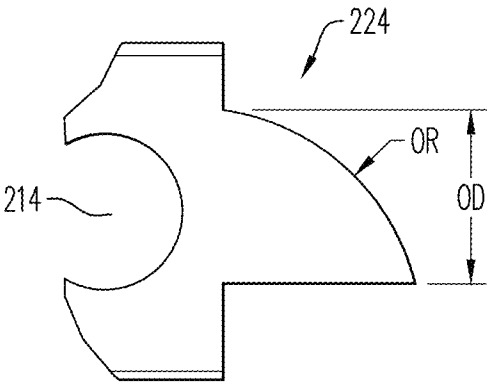
FIG. 10 is an enlarged side view of a first side the adjustable neutral bar assembly of FIG. 7.

In some embodiments and as shown in FIGS. 10-11, first end 222 has an inner dimension (ID) and an inner radius (IR) that are smaller than an outer dimension (OD) and an outer radius (OR), respectively, of second end 224. In this way, ends 222, 224 can form an interference fit when engaged, with connector 230 adding compression to the engagement to form a secure mechanical and electrical connection.

As in the embodiments discussed above, ends 222, 224 can be positioned so that holes 226, 228 and connector 230 are parallel to second opening 216 and screw 220 or can be positioned so that the holes and the connector are parallel to the first openings 214 and the neutral conductors (not shown). Similarly, assembly 210 can include bars 212 having ends 222, 224 configured so that the user can select the angle of the bars with respect to one another.

Advantageously, assembly 210 combines two identically shaped bars 212, minimizing the number of components necessary to adjust (i.e., expand or contract) the number of taps available. Moreover, when connector 230 is identical to screw 220, assembly 210 requires no more parts than would be required when installing only one bar 212. Since there is no modification necessary to the structure of bars 212, assembly 210 can maintain any safety certification in the as installed state.

It should be recognized that although bars 212 are described as being identically shaped, it is contemplated by the present disclosure for this to mean that the ends 222, 224 are shaped in a corresponding manner so as to allow for connection of the bars as described. In this way, bars 212 having a different number of taps can be connected together to adjust the number of taps as desired.

Accordingly, bars 212—as a result of ends 222, 224—are considered by the present disclosure to be adjustable neutral bars.

While not shown, it is contemplated by the present disclosure for one or more of the first and/or second ends of the embodiments in FIGS. 1-11 to have teeth or crenulations that can bite into and/or score the surface of the opposite end. In this manner, the ends can cut through any oxidation or non-conductive material to ensure electrical conductivity between the bars.

Figure 13:
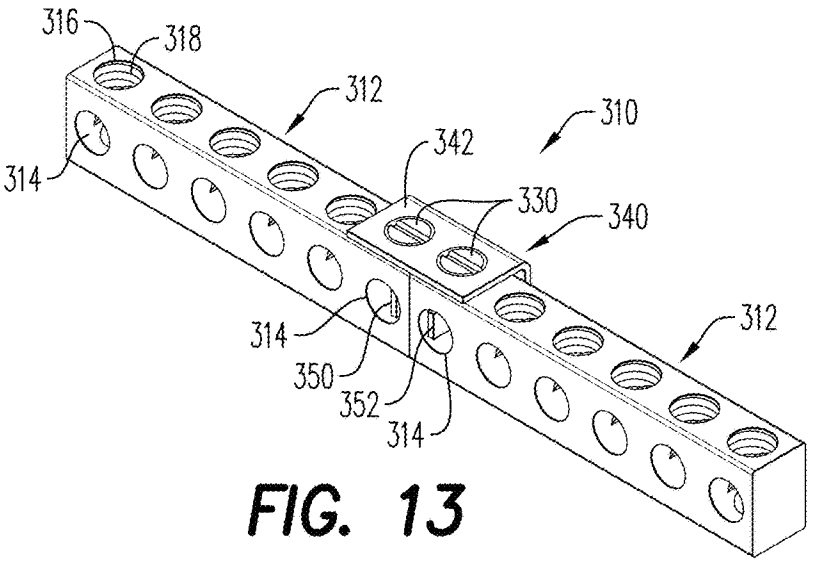
FIG. 13 is a second, opposite perspective view of the adjustable neutral bar assembly of FIG. 12.
Figure 12:
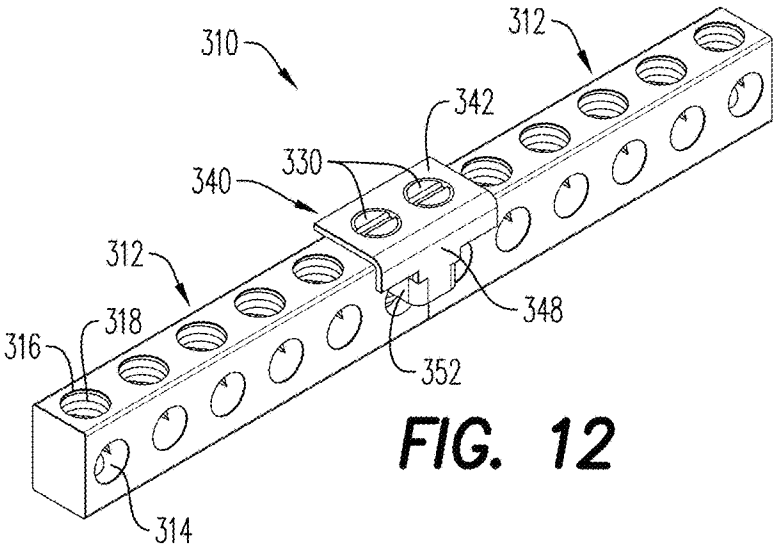
FIG. 12 is a first perspective view of another adjustable neutral bar assembly according to the present disclosure.
Figure 14:
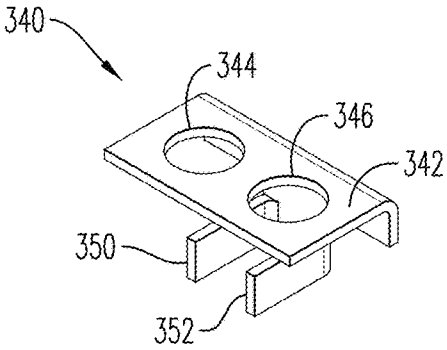
FIG. 14 is a perspective view of a clip of the adjustable neutral bar assembly of FIG. 12.
Figure 15:
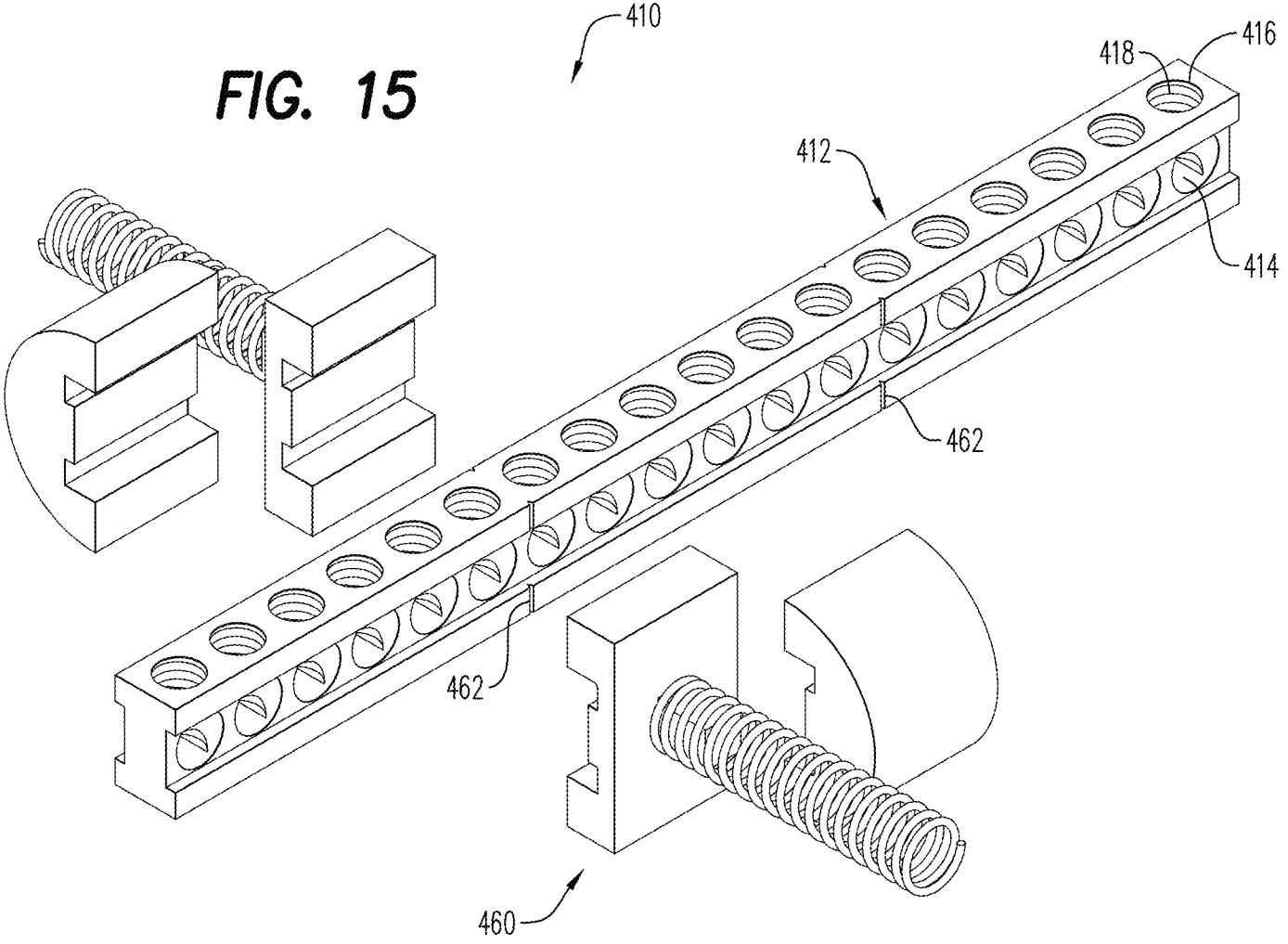
FIG. 15 is a perspective view of an adjustable neutral bar and shearing die set according to the present disclosure.
Figure 17:
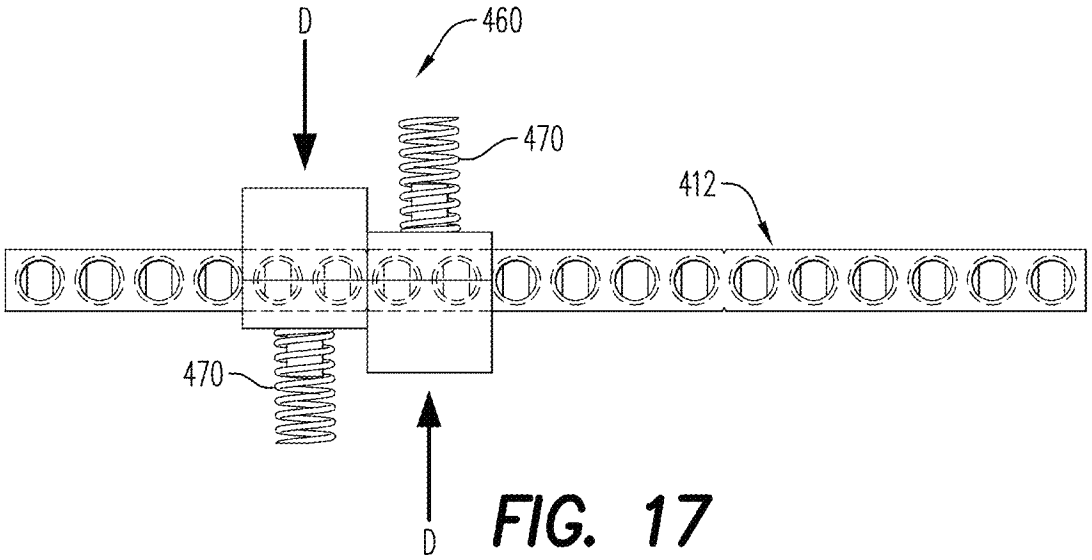
FIG. 17 is a top view of the adjustable neutral bar and sheering device of FIG. 16.
Figure 16:
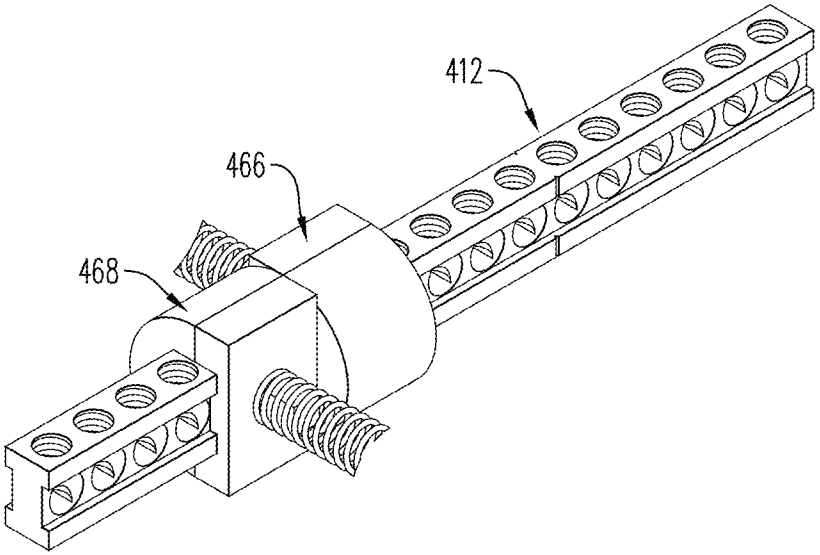
FIG. 16 is a perspective view of the adjustable neutral bar assembled with the sheering die set of FIG. 15.
Figure 18:
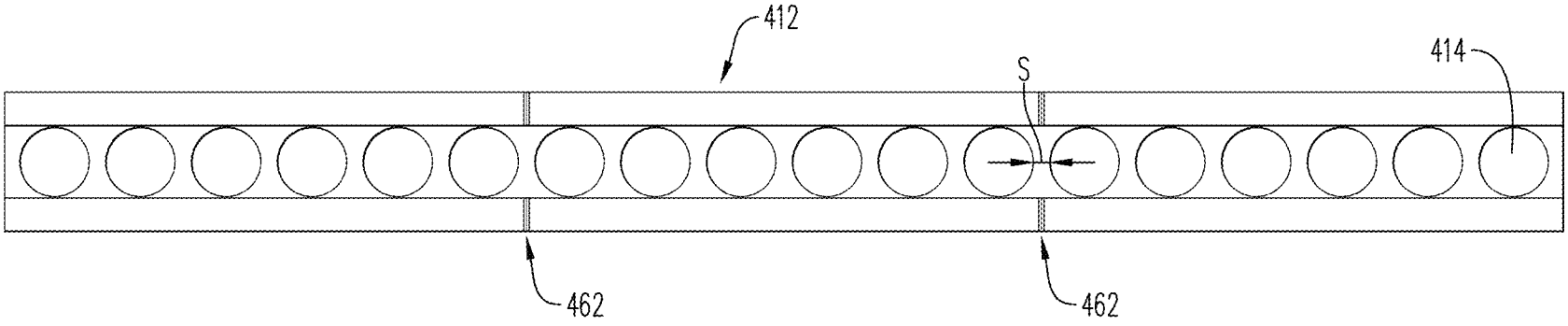
FIG. 18 is a side view of the adjustable neutral bar of FIG. 15.
Figure 19:
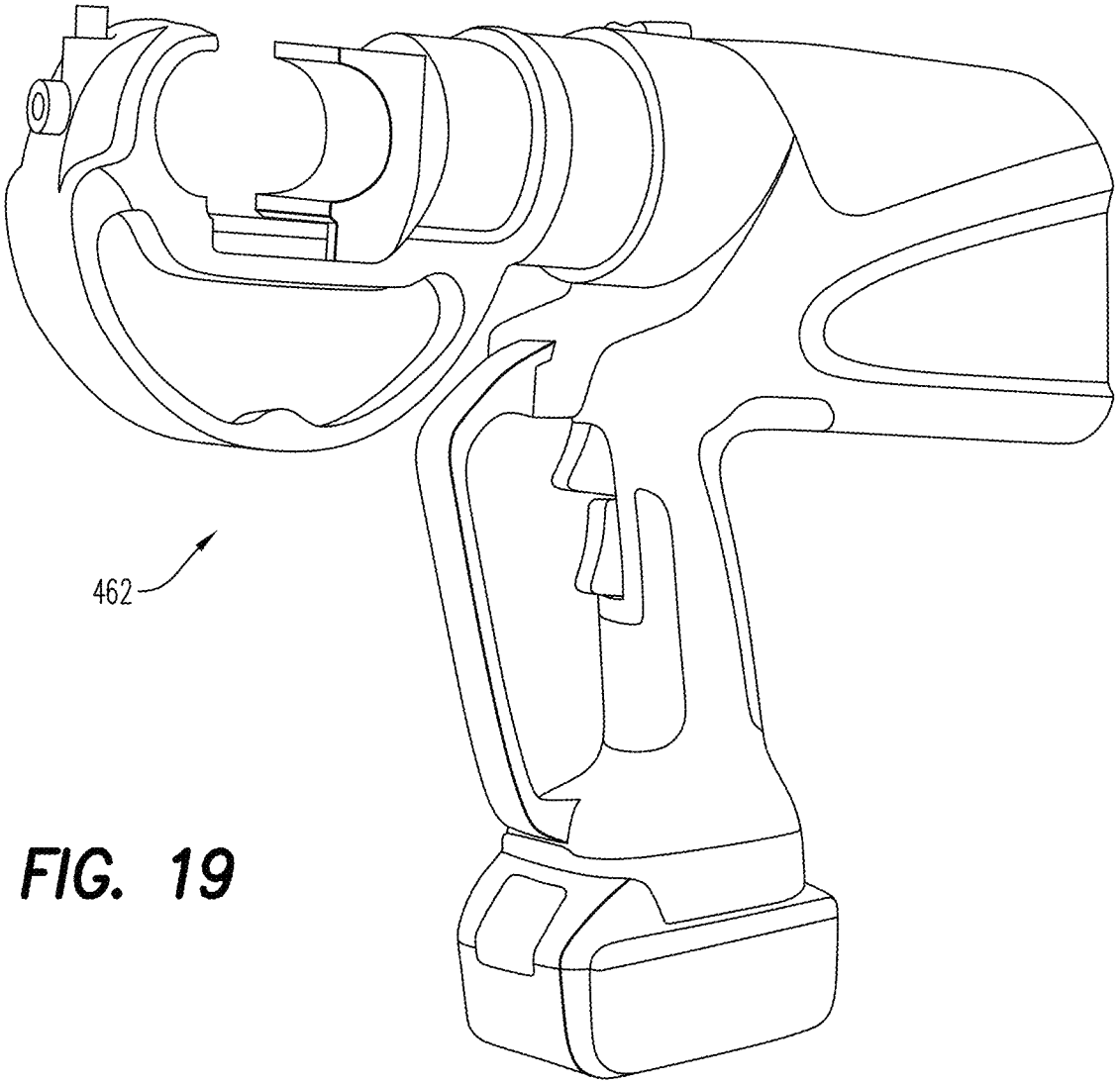
FIG. 19 is a perspective view of an exemplary embodiment of a crimping tool for use with the shearing die set of FIG. 15.

Turning now to FIGS. 12-14, another exemplary embodiment of an adjustable neutral bar assembly according to the present disclosure is shown and is generally referred to by reference numeral 310. Advantageously, assembly 310 is configurable to provide any desired number of taps by joining a plurality of neutral bars 312 to one another using a clip 340.

Each bar 312 includes a first opening 314 and a second opening 316. Each first opening 314 is sized to receive a neutral conductor (not shown). Each second opening 316 has an internal thread 318, configured to threadably receive a wire-binding screw (not shown) therein. First and second openings 314, 316 are positioned with respect to one another to allow the wire-binding screw to be selectively tightened in the second opening to mechanically secure the neutral conductor in the first opening in an electrically conductive manner.

Clip 340 includes an upper section 342 with first and second holes 344, 346. Holes 344, 346 are positioned on upper section 342 so that when two bars 312 are placed end-to-end, first hole 344 aligns with second opening 316 of one bar and second hole 346 aligns with second opening 316 of the other bar. In this manner, a screw 330—such as the wire-binding screw that is normally used to secure neutral conductors in first openings 314—can be used to mechanically and electrically secure clip 340 and the two bars 312 together.

Clip 340 includes a lower section 348 with first and second extensions 350, 352. Extensions 350, 352 are positioned on lower section 348 so that when two bars 312 are placed end-to-end, first extension 350 aligns with first opening 314 of one bar and second extension 352 aligns with first opening 314 of the other bar. In this manner, extensions 350, 352 further mechanically and electrically secure the two bars 312 and clip 340 to one another with the ends of the bars facing and/or abutting one another.

In some embodiments, clip 340 is configured so that extensions 350, 352 resiliently bias the two bars 312 towards one another.

Advantageously, clip 340 is configured to mechanically and electrically secure two bars 312 to one another without any modification to the bars. Thus, clip 340 can be used with existing neutral bars to form assembly 310 with as many taps as needed.

Assembly 310 combines two identically shaped bars 312, minimizing the number of components necessary to expand/contract the number of taps available—namely requiring only clip 340. Since there is no modification necessary to the structure of bars 312, assembly 310 can maintain any safety certification in the as installed state.

Referring now FIGS. 15-19, another exemplary embodiment of an adjustable neutral bar assembly is shown and is generally referred to by reference numeral 410. Advantageously, assembly 410 is configurable to provide any desired number of taps by shearing a shearable neutral bar 412 using a set of shearing die set 460.

Bar 412 include first opening 414 and second opening 416 having internal thread 418, configured to threadably receive a wire-binding screw (not shown). First and second openings 414, 416 are positioned with respect to one another to allow the wire-binding screw to be selectively tightened in the second opening to mechanically secure the neutral conductor in the first opening in an electrically conductive manner.

Bar 412 further includes a shearing region 462 defined between two first openings 414. Here, bar 412 is configured so that the spacing (S) between the openings 414 having region 462 is sufficient so that, after shearing at the region, the bar maintains the desired safety certification. In the illustrated embodiment, bar 412 is shown having two regions 462. However, it is contemplated by the present disclosure for bar 412 to have as few as one and as many as thirty regions 462.

Accordingly, bars 412—as a result of region 462—are considered by the present disclosure to be adjustable neutral bars.

It should be recognized that bars 412 are illustrated by way of example having region 462 positioned parallel to second openings 416. However, it is also contemplated by the present disclosure for bars 412 to be configured so that region 462 is positioned parallel to first openings 414.

Bar 412 can be easily sheared using shear die set 460 or other devices, minimizing the number of components necessary to adjust the number of taps available. Since the modification to bar 412 occurs at regions 462 having spacing (S), the bars can maintain any safety certification in the as installed state.

In some embodiments, bar 412 can be assembled with shear die set 460 to form assembly 410. Shear die set 460 finds use with crimping tools such 464 as, but not limited to, shown in FIG. 19, which are commercially available from Hubbell Incorporated.

Shear die set 460 includes a first set of shear blocks 466 and a second set of shear blocks 468. Blocks 466 are positioned around bar 412 at one side of region 462, while blocks 468 are positioned around the bar at an opposite side of the region. In this manner, region 462 defines a shearing plane for the shearing of bar 412 via the movement of blocks 466, 468 in opposite directions (D).

In some embodiments, region 462 can act as a physical locator that interacts with one or more portions of die set 460 to ensure proper location of the die set with respect to the bar. Additionally in some embodiments, die set 460 can include a retention spring 470 configured to assist in holding and/or maintaining bar 412 in the die set during use of tool 464.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood that various changes may be made and equivalents may be substituted for elements thereof without departing from the scope. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An adjustable neutral bar, comprising:

a plurality of wire-binding screws;

a plurality of first openings each being sized to receive a different neutral conductor;

a plurality of second openings passing from a first face to a second face and each having a thread configured to threadably receive a different one of the plurality of wire-binding screws therein, wherein the first and second openings are positioned with respect to one another to allow the plurality of wire-binding screws to be selectively tightened in the plurality of second openings to mechanically secure the different neutral conductor in the plurality of first openings in an electrically conductive manner;

a first bar end having a first hole having the thread; and a second bar end having a second hole having the thread, wherein the first bar end has a first shape at the first face and the second bar end has a second shape at the second face, wherein the first and second shapes are positioned and shaped so that the first end of one neutral bar is mateable with the second end of a different neutral bar and, when mated, the first and second holes align with one another and so that one of the plurality of wire-binding screws is threadably engageable with the threads of the first and second holes to join the one neutral bar and the different neutral bar.

2. The adjustable neutral bar of claim 1, wherein the first and second shapes are step shapes.

3. The adjustable neutral bar of claim 1, wherein the first and second shapes are quadrangle shapes.

4. An adjustable neutral bar, comprising:

a plurality of wire-binding screws;

a plurality of first openings each being sized to receive a different neutral conductor;

a plurality of second openings each having a thread configured to threadably receive a different one of the plurality of wire-binding screws therein, wherein the first and second openings are positioned with respect to one another to allow the plurality of wire-binding screws to be selectively tightened in the plurality of second openings to mechanically secure the different neutral conductor in the plurality of first openings in an electrically conductive manner;

a first bar end having a first hole having the thread; and a second bar end having a second hole having the thread, wherein the first and second bar ends are positioned and shaped so that the first end of one neutral bar is mateable with the second end of a different neutral bar and, when mated, the first and second holes align with one another and so that one of the plurality of wire-binding screws is threadably engageable with the threads of the first and second holes to join the one neutral bar and the different neutral bar, wherein the first end has a female shape and the second end has a male shape that corresponds to the female shape, and wherein the first and second ends form an interference fit when engaged.

5. The adjustable neutral bar of claim 4, wherein the first end has an inner dimension that is smaller in at least one direction than an outer dimension of the second end.

6. The adjustable neutral bar of claim 5, wherein the first end has an inner radius (IR) that is smaller than an outer radius (OR) of the second end.

7. The adjustable neutral bar of claim 4, wherein the male and female shapes are quadrangle shapes.

8. An adjustable neutral bar, comprising:

a plurality of wire-binding screws;

a plurality of first openings each being sized to receive a different neutral conductor;

a plurality of second openings each having a thread configured to threadably receive a different one of the plurality of wire-binding screws therein, wherein the first and second openings are positioned with respect to one another to allow the plurality of wire-binding screws to be selectively tightened in the plurality of second openings to mechanically secure the different neutral conductor in the plurality of first openings in an electrically conductive manner; and a shearing region defined between two of the first openings and/or two of the second openings that are adjacent to one another, respectively.

9. The adjustable neutral bar of claim 8, wherein the shearing region has a predefined spacing between the two of the first openings and/or the two of the second openings.

10. The adjustable neutral bar of claim 8, wherein the shearing region define a shearing plane for the shearing of the neutral bar.

11. The adjustable neutral bar of claim 8, wherein the shearing region is a physical locator that can interact with a die set to ensure proper location of the die set with respect to the shearing region.

12. An adjustable neutral bar assembly, comprising:

two neutral bars, each neutral bar comprising a plurality of wire-binding screws;

a plurality of first openings each being sized to receive a different neutral conductor;

a plurality of second openings passing from a first face to a second face and each having a thread configured to threadably receive a different one of the plurality of wire-binding screws therein, wherein the first and second openings are positioned with respect to one another to allow the plurality of wire-binding screws to be selectively tightened in the plurality of second openings to mechanically secure the different neutral conductor in the plurality of first openings in an electrically conductive manner;

a first bar end having a first hole passing from the first face to a third face and having the thread; and a second bar end having a second hole passing from the second face to a fourth face and having the thread; and one of the plurality of wire-binding screws passing from the first face of the first bar end to the second face of the second bar end to mechanically and electrically securing the first bar end of one of the two neutral bars and the second bar end of the other of the two neutral bars by threadably engaging the threads of the first hole of the first end and the threads of the second hole of the second end, which are aligned with one another.

13. The adjustable neutral bar assembly of claim 12, wherein the first and second ends have a step shape.

14. The adjustable neutral bar assembly of claim 12, wherein, when the one of the plurality of wire-binding screws secures the first bar end and the second bar end, the third and fourth faces in contact with one another.

15. The adjustable neutral bar assembly of claim 14, wherein the male and female shapes are quadrangle shapes.

16. An adjustable neutral bar assembly, comprising:

two neutral bars, each neutral bar comprising a plurality of wire-binding screws;

a plurality of first openings each being sized to receive a different neutral conductor;

a plurality of second openings each having a thread configured to threadably receive a different one of the plurality of wire-binding screws therein, wherein the first and second openings are positioned with respect to one another to allow the plurality of wire-binding screws to be selectively tightened in the plurality of second opening to mechanically secure the different neutral conductor in the plurality of first openings in an electrically conductive manner;

a first bar end having a first hole having the thread; and a second bar end having a second hole having the thread; and one of the plurality of wire-binding screws mechanically and electrically securing the first bar end of one of the two neutral bars and the second bar end of the other of the two neutral bars by threadably engaging the threads of the first hole of the first end and the threads of the second hole of the second end, which are aligned with one another, wherein the first end has a female shape and the second end has a male shape that corresponds to the female shape, and wherein the first and second ends form an interference fit when engaged.

17. An adjustable neutral bar assembly, comprising:

two neutral bars, each neutral bar comprising a plurality of wire-binding screws;

a plurality of first openings each being sized to receive a different neutral conductor;

a plurality of second openings each having a thread configured to threadably receive a different one of the plurality of wire-binding screws therein, wherein the first and second openings are positioned with respect to one another to allow the plurality of wire-binding screws to be selectively tightened in the plurality of second openings to mechanically secure the different neutral conductor in the plurality of first openings in an electrically conductive manner;

a first bar end; and a second bar end; and a clip mechanically and electrically securing the two neutral bars to one another so that the first bar end of one of the two neutral bars and the second bar end of the other of the two neutral bars face and/or abut one another, wherein the clip comprises an upper section with a first hole and a second hole, the first and second holes being positioned on the upper section so that the first hole aligns with the second opening of one of the two neutral bars and the second hole aligns with the second opening of the other of the two neutral bars, and wherein one of the plurality of wire-binding screws mechanically and electrically secures the clip via the thread of the first hole to one of the two neutral bars, and wherein another of the plurality of wire-binding screws mechanically and electrically secures the clip via the thread of the second hole to the other of the two neutral bars.

18. The adjustable neutral bar assembly of claim 17, wherein the clip further comprises a lower section having a first extension and a second extension, the first and second extensions being positioned on the lower section so that the first extension aligns with the first opening of one of the two neutral bars and the second extension aligns with the first opening of the other of the two neutral bars.

* * * * *